US006532691B2

(12) United States Patent
Carlin et al.

(10) Patent No.: US 6,532,691 B2
(45) Date of Patent: Mar. 18, 2003

(54) DISPLAY DEVICE

(75) Inventors: Glenn Carlin, Kent, CT (US); Gil Aviles, Accord, NY (US)

(73) Assignee: Crew Design Incorporated, Kent, CT (US)

( * ) Notice: Subject to any disclaimer, the term of this patent is extended or adjusted under 35 U.S.C. 154(b) by 0 days.

(21) Appl. No.: 09/901,235

(22) Filed: Jul. 9, 2001

(65) Prior Publication Data

US 2003/0005611 A1 Jan. 9, 2003

(51) Int. Cl.[7] ..... G09F 11/00
(52) U.S. Cl. ..... 40/491; 40/490
(58) Field of Search ..... 40/445, 488, 490, 40/491, 597, 611; 116/321, 323, 324

(56) References Cited

U.S. PATENT DOCUMENTS 401,094 A * 4/1889 Winterdorf et al. ..... 40/491 X
453,711 A * 6/1891 Molin ..... 40/488 X
516,884 A * 3/1894 Attaway ..... 40/611
2,536,645 A * 1/1951 Johnson et al. ..... 40/490
4,044,485 A * 8/1977 Hopp ..... 40/324
4,756,106 A * 7/1988 Foster ..... 40/490 X
4,896,855 A * 1/1990 Furnish ..... 248/291 X
5,025,919 A * 6/1991 Brinker et al. ..... 40/442 X
5,608,979 A * 3/1997 Johnson ..... 40/491
5,700,051 A * 12/1997 Newhouse ..... 40/320 X
5,913,615 A * 6/1999 Rellinger ..... 40/491
6,427,836 B1 * 8/2002 Bolanos ..... 40/654.01

OTHER PUBLICATIONS

Ad–Tech LLC, "INFOSHADE ®", Los Angeles, CA, www.infoshade.com, 1 page.

* cited by examiner

*Primary Examiner*—Brian K. Green
(74) *Attorney, Agent, or Firm*—McCormick, Paulding & Huber LLP

(57) ABSTRACT

A display device includes a rigid back cover to be attached to a mounting surface. A rigid front cover is positioned in overlying relationship to the back cover for showing product identification information, and a rigid panel is provided having a grip portion and a support portion for holding an information sheet. The panel is between and movable relative to the covers from a retracted position to an extended position. The panel in the retracted position has the support portion underlying and hidden by the front cover and the grip portion projecting outwardly from the front cover for providing access to pull the panel to the extended position. The panel in the extended position has the support portion projecting outwardly from the front cover, whereby the information sheet is hidden by the front cover when the panel is retracted, and the information sheet is exposed when the panel is extended.

12 Claims, 9 Drawing Sheets

DISPLAY DEVICE

FIELD OF THE INVENTION

This invention relates generally to a device for displaying information, and more particularly to a display device, with a pull-down information panel, to be attached to a shelf or other mounting surface for displaying advertisements or other information.

BACKGROUND OF THE INVENTION

Display devices attached to shelves for advertising products are well known. Some display devices permit a potential consumer to interact with the device. Such interaction is desirable because some studies suggest that the interaction increases the likelihood of sales by 29% to 50%.

One such interaction display device comprises a flexible advertisement sheet that is initially wound on a roller. The potential consumer may unwind the advertisement sheet from the roller to reveal the advertisement. The roller is biased such that when the advertisement sheet is automatically wound on the roller when the consumer releases the sheet. A drawback with this pull-down display is that the advertisement sheet is not easily replaceable. The sheet may be permanently attached to the roller such that roller and sheet must be replaced as a unit or the entire display unit must be removed while changing the sheet. Replacing both roller and sheet is significantly more expensive and time consuming than replacing the sheet alone. Another drawback is that the flexible sheet easily wears with each pull, and therefore has a limited operational life.

It is an object of the present invention to provide an improved information display device that is durable.

It is a further object of the present invention to provide an information display device in which information shown on the display device is easily replaceable.

SUMMARY OF THE INVENTION

A display device includes a substantially rigid back cover to be attached to a shelf or other mounting surface. A substantially rigid front cover is positioned in overlying relationship to the back cover for showing product identification information, and a substantially rigid panel is provided having a grip portion and a support portion for holding an information sheet. The panel is generally interposed between and movable relative to the covers from a retracted position to an extended position. The panel in the retracted position has the support portion in substantially underlying relationship to and hidden by the front cover and the grip portion projecting outwardly from an edge of the front cover for providing access to pull the panel to the extended position. The panel in the extended position has the support portion substantially projecting outwardly from the front cover, whereby the information sheet is hidden by the front cover when the panel is in the retracted position, and the information sheet is exposed when the panel is in the extended position. Preferably, the panel is biased toward the retracted position. The support portion of the panel includes a support surface and preferably includes a plurality of projections about a periphery of the support portion for retaining the information sheet against the support surface. The support portion may define an opening for providing access to a back side of the information sheet so that the sheet may be pushed against and removed when the panel is in the extended position.

An advantage of the present invention is that the rigid construction of the display device including pull-down panel provides a significantly increased operational life relative to roller operated pull-down display devices.

Another advantage is that the information sheet on the pull-down panel may be easily removed and replaced on-site.

These and other advantages of the present invention will become more apparent in the light of the following detailed description and accompanying figures.

DETAILED DESCRIPTION OF THE PREFERRED EMBODIMENTS

Figure 1:
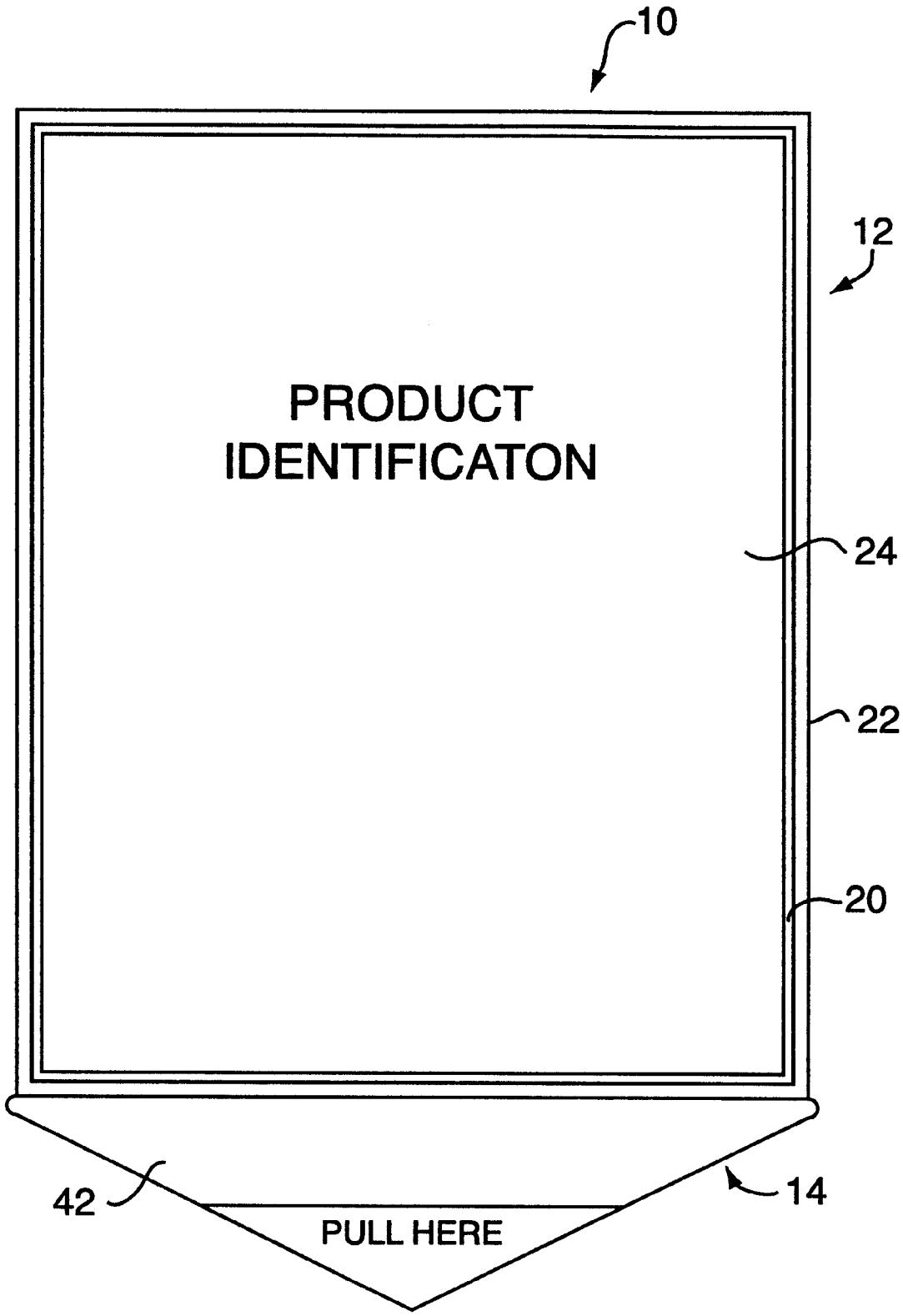
FIG. 1 is a top plan view of a display device embodying the present invention with a pull-down panel in a retracted position.

With reference to FIGS. 1–12, a display device embodying the present invention is generally designated by the reference number 10. As shown in the side view of FIG. 8, the device 10 includes a front cover 12 for showing graphic information such as an advertisement, a pull-down panel 14 for showing additional graphic or advertisement information, a back cover 16 and a bracket 18 to be coupled to the back cover for attaching the device 10 to a store or gondola shelf or other mounting surface such as an automobile window or glass surface of a refrigeration case. The covers 12, 16, the panel 14 and the bracket 18 are made from a substantially rigid material for durability and long operational life such as, for example, an injection molded, high impact polystyrene plastic.

As shown in FIG. 1, the front cover 12 has a support surface 20 slightly recessed from peripheral edges 22 for mounting thereon a sheet 24 containing graphic information such as, for example, a product identification or advertisement. The support surface 20 is recessed in order to aid in registration of the sheet thereon when updated in the field. The information on the sheet 24 may be, for example, printed on 12–20 pt. tag stock cards that are applied as pressure sensitive labels or otherwise adhesively attached to the support surface 20 of the front cover 12. Alternatively, the front cover 12 may have information directly printed or otherwise incorporated thereon without departing from the scope of the present invention.

Figure 5:
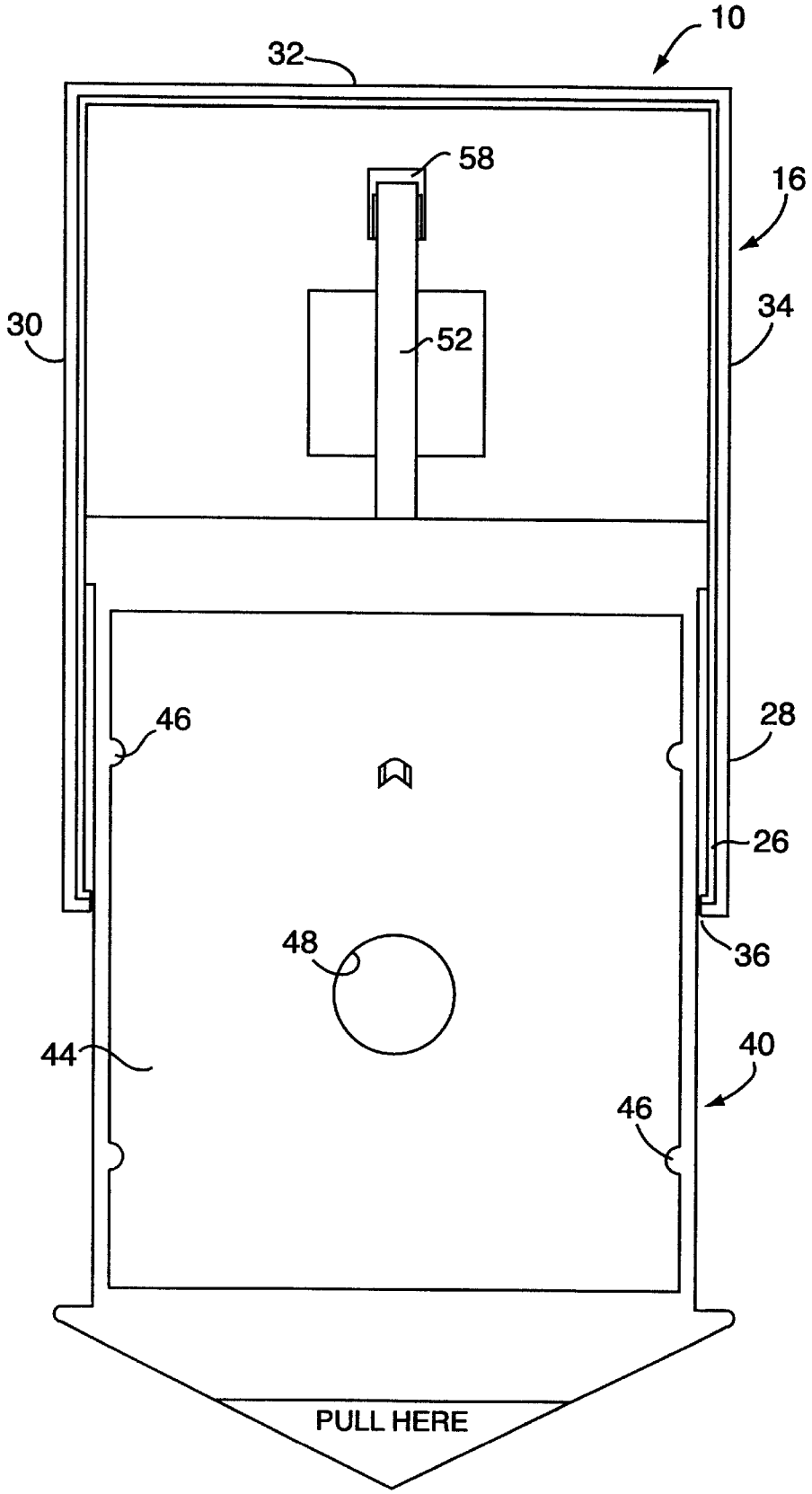
FIG. 5 is a bottom plan view of the display device of FIG. 1 with the back cover removed and the pull-down panel in a partially extended position.
Figure 6:
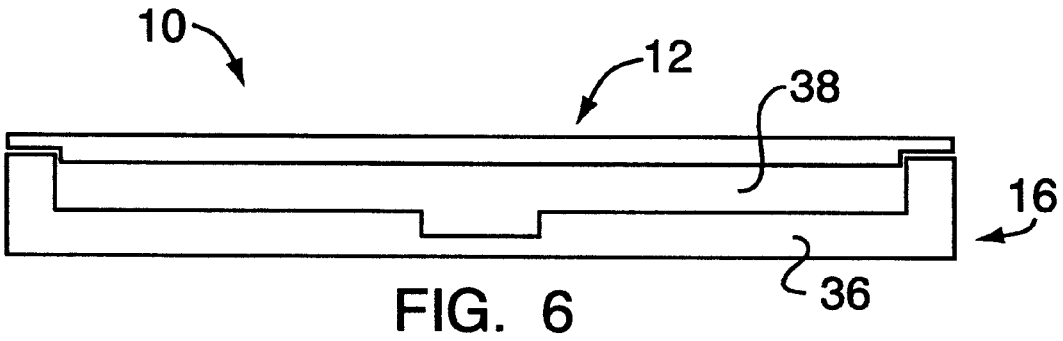
FIG. 6 is an edge view of the front cover and the back cover defining a channel for receiving the pull-down panel.

As shown in FIG. 5, the back cover 16 defines a ledge 26 extending along side ends 28, 30 and top end 32 that is slightly recessed from a peripheral edge 34 for receiving in overlying relationship the front cover 12 which is press-fitted or otherwise secured to the back cover. The ledge 26 of the back cover 16 does not extend along a bottom end 36 of the back cover. As shown in FIG. 6, the bottom end of the back cover 16 and front cover 12 at 36 cooperate to define a channel 38, opening thereat and extending substantially to an opposite end of the covers, in which a portion of the panel 14 (not shown in FIG. 6) may be movably accommodated.

Figure 2:
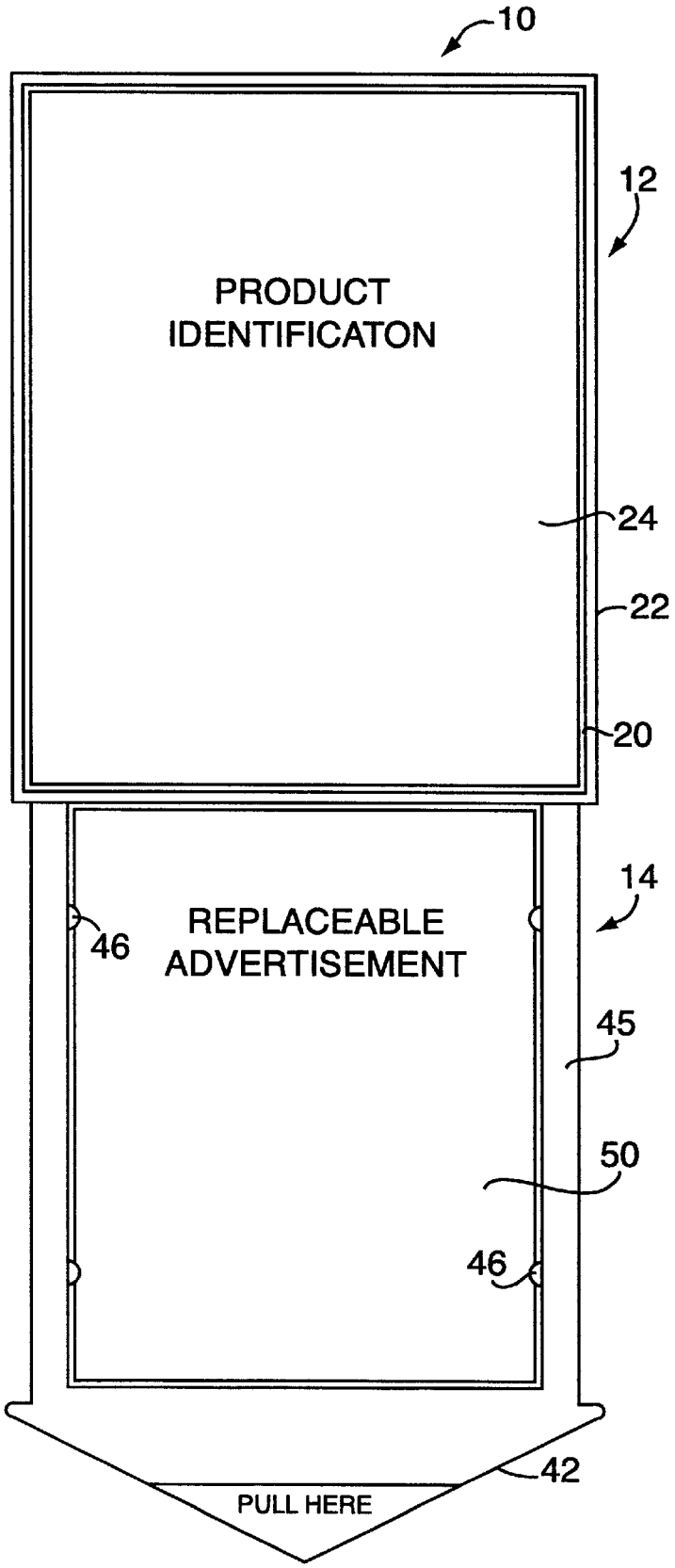
FIG. 2 is a top plan view of the display device of FIG. 1 with the pull-down panel in an extended position.

As best shown in FIG. 2, the panel 14 includes a generally rectangular support portion 40, showing graphic information such as an advertisement, and a grip portion 42 extending downwardly therefrom. Preferably, the grip portion 42 is in the form of an arrow pointing away from the covers 12, 16 in the direction to be pulled, and includes directions such as, for example, "PULL HERE" to aid the consumer in how to properly pull the grip portion of the panel 14 from a retracted position to an extended position to expose graphic information such as an advertisement held on the support portion 40 of the panel. The backside of the grip portion preferably defines ribs 43, 43 (see FIGS. 3 and 4) to provide an enhanced gripping surface. The support portion 40 of the panel 14 is movable within the channel 38 from a retracted position where the support portion 40 is in underlying relationship with and generally hidden by the front cover 12 (see FIG. 1), to an extended position where the support portion is generally exposed (see FIG. 2).

With reference to FIG. 5, the support portion 40 of the panel 14 includes a support surface 44 recessed from a peripheral edge 45 for holding an information sheet thereon. The support portion 40 also preferably includes a plurality of projections or tabs 46, 46 positioned about a periphery of the support portion, and spaced above and extending inwardly over the periphery of the support surface 44 for retaining the information sheet against the support surface.

Preferably, an opening 48 is defined by the support portion 40 of the panel 14 for providing access to a back side of the information sheet 50, as shown in FIG. 2, supported thereon so that the sheet may be pushed against and easily removed on-site when the panel is in an extended position. Another information sheet may then be placed against the support surface 44 and retained thereon by the tabs 46, 46.

Figure 3:
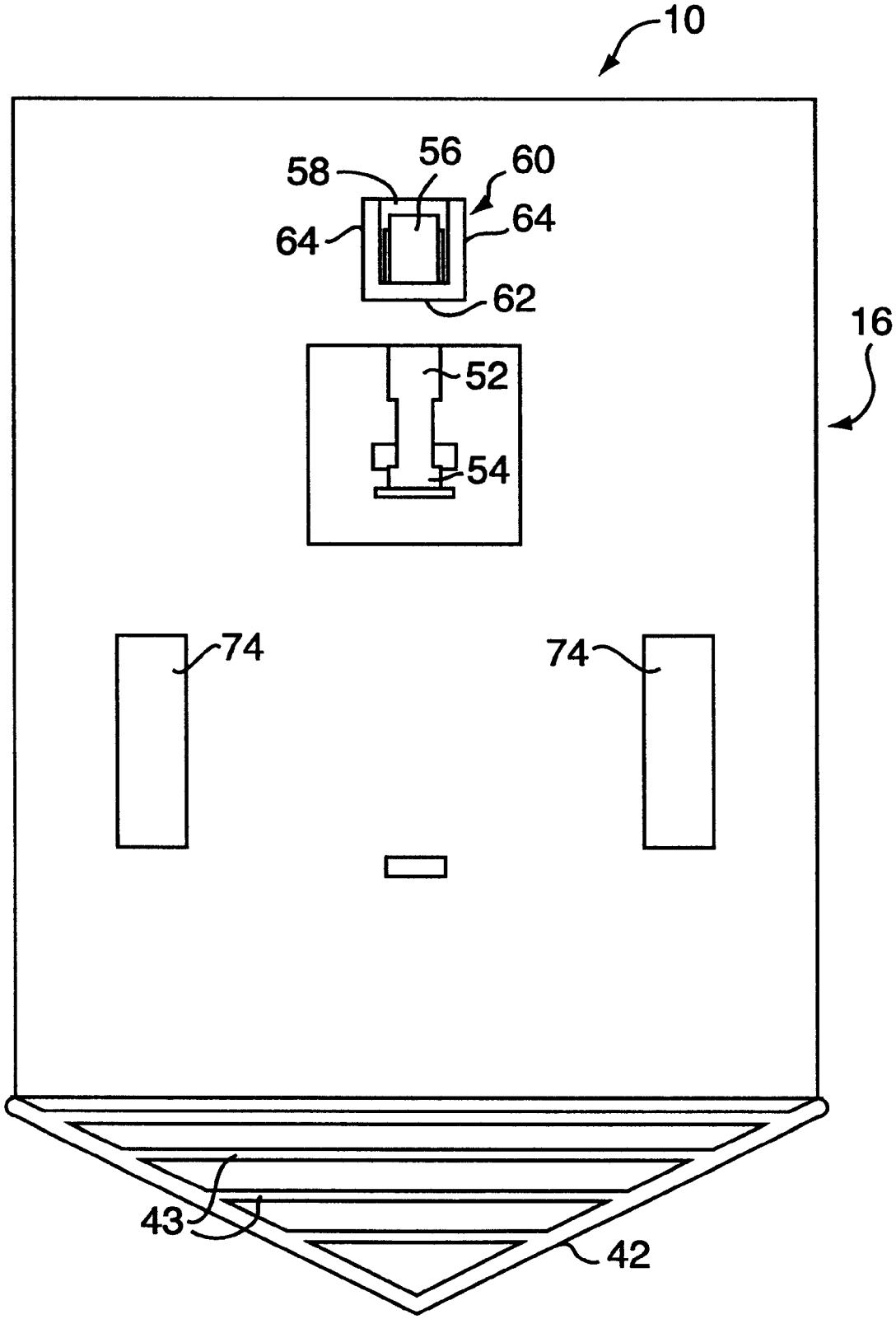
FIG. 3 is a bottom plan view of the display device of FIG. 1 with the pull-down panel in the retracted position.
Figure 4:
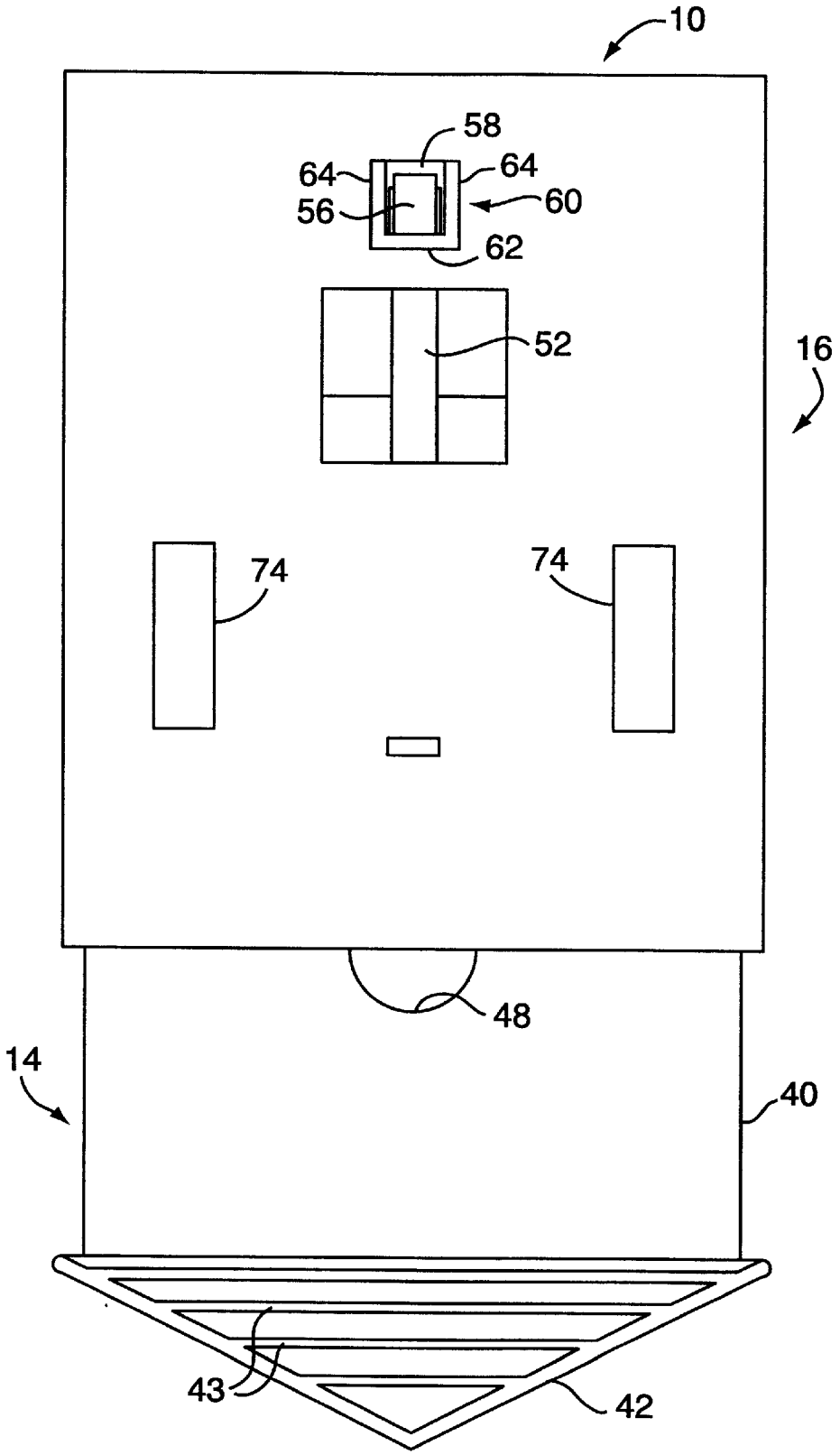
FIG. 4 is a bottom plan view of the display device of FIG. 1 with the pull-down panel in a partially extended position.

The display device 10 includes means for biasing the panel 14 in a retracted position. Preferably, as shown in FIGS. 3–5, the biasing means is a spring 52 in the form of a flat strip that in the absence of tension is a tightly wound spiral. The spring 52 has one end 54 that is generally unwound and coupled to an upper back side of the support portion 40 of the panel 14 and a free wound end 56 extending outwardly through an opening 58 defined by the back cover 16 such that the wound end 56 is retained in position by a shelf 60 extending rearwardly from the back cover. The shelf 60 includes a ledge 62 and preferably includes sidewalls 64, 64 for retaining the wound end 56 of the spring 52 in position over the ledge 62. The ledge 62 is located slightly below the opening 58 so that the wound end 56 of the spring 52 generally bears against a surface of the back cover 16 below the opening to thereby prevent the spring from becoming inoperative by retracting as a whole through the opening of the back cover.

Figure 7:
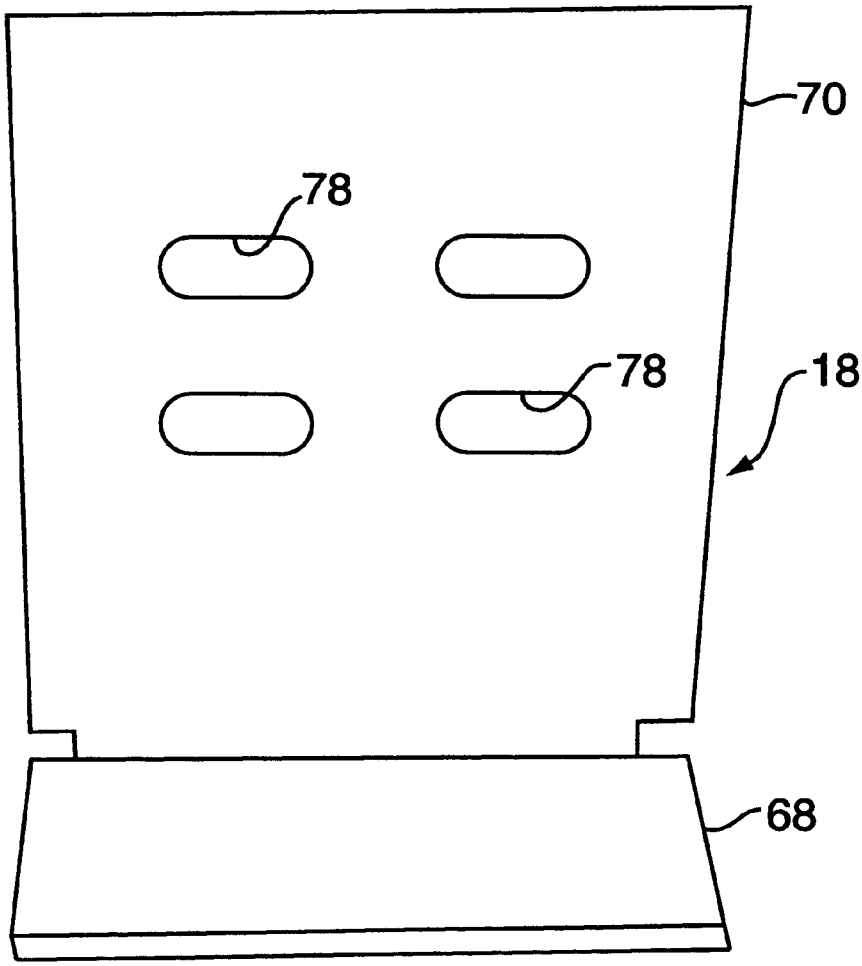
FIG. 7 is a perspective view of a mounting bracket to be coupled to the back cover of the display device of FIG. 1.
Figure 9:
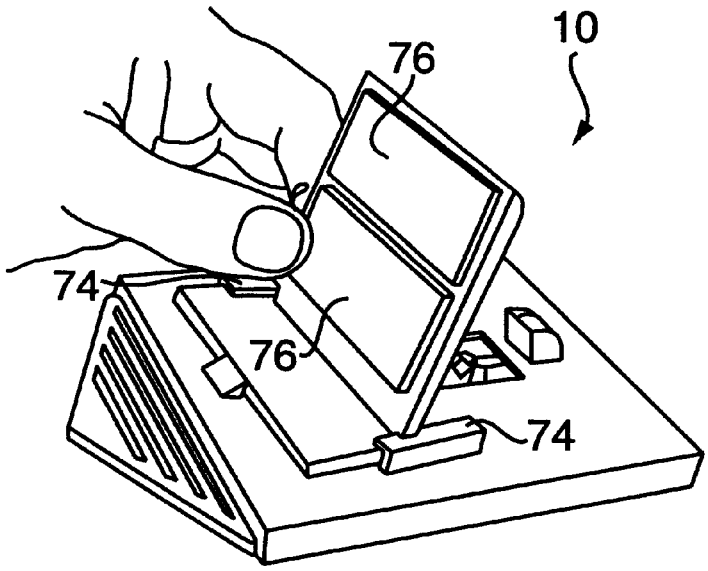
FIG. 9 is a back perspective view of the display device of FIG. 1 showing the bracket mounted thereon.
Figure 10:
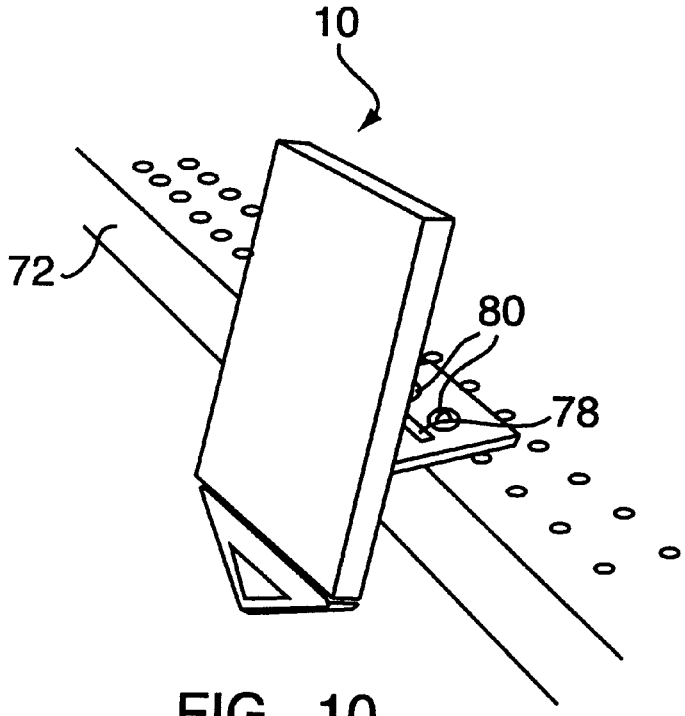
FIG. 10 is a front perspective view of the display device of FIG. 1 mounted on a shelf.

As shown in FIG. 7, the mounting bracket 18 includes a first portion 68 for coupling the bracket to the back cover 16 of the display device 10, and a second portion 70 for mounting the display device to a mounting surface such as, for example, the product shelf 72 shown in FIG. 10. As shown in FIG. 9, the bracket 18 may be releasably coupled to the back cover 16 of the display device 10 by sliding the first portion 68 of the bracket between guide channels 74, 74 projecting rearwardly from the back cover. The display device 10 may be secured to a product shelf or other mounting surface with double-sided adhesive 76, 76 having one side adhered to the second end 70 of the bracket 18 and the other end secured to the shelf 72 or other mounting surface. Alternatively, as shown in FIGS. 7 and 10, the second portion 70 of the bracket 18 defines a plurality of openings or slots 78, 78 for accommodating means for fastening the bracket to the shelf 72, such as the screws 80,80 shown in FIG. 10.

Figure 8:
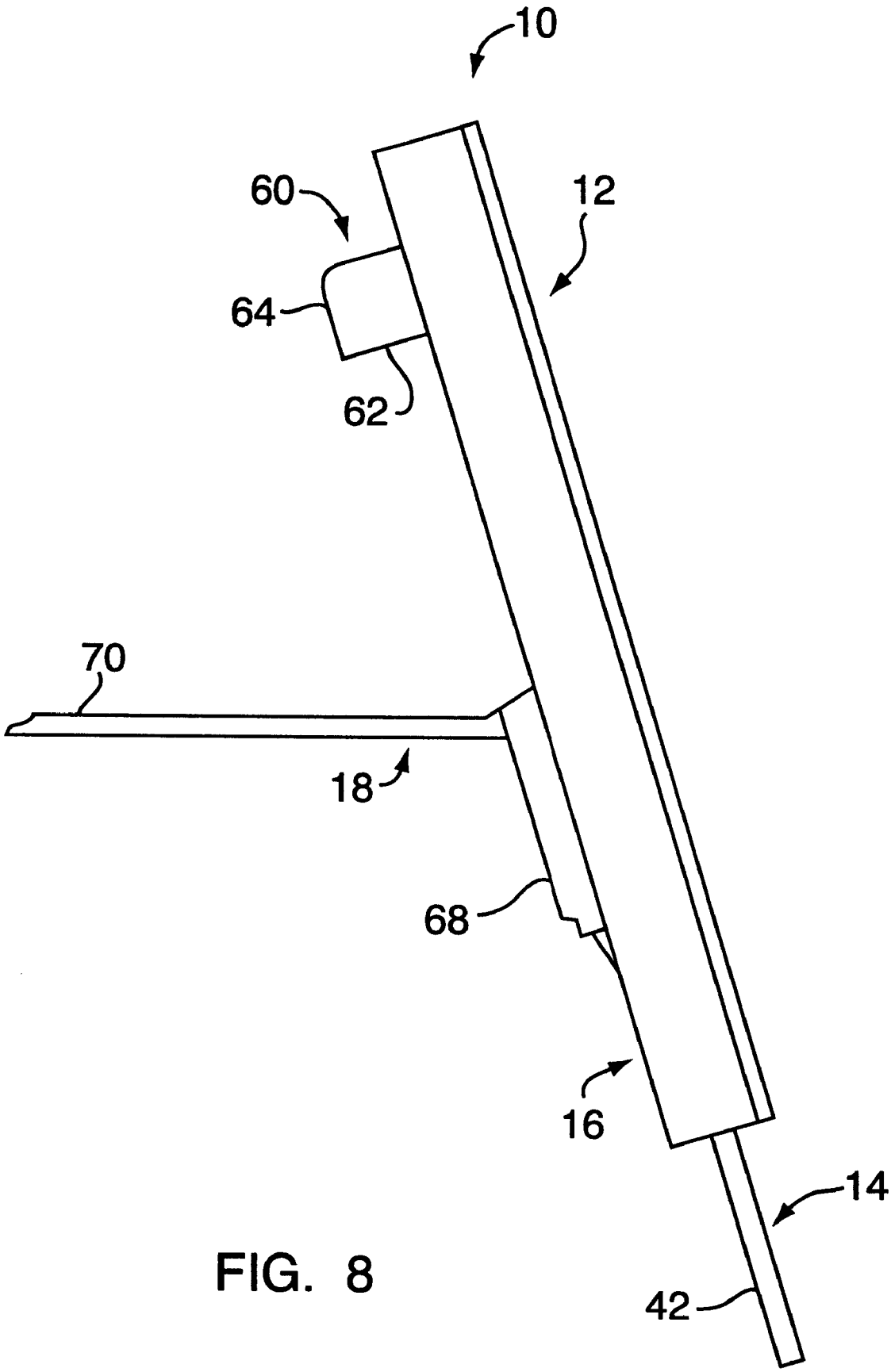
FIG. 8 is a side elevational view of the display device of FIG. 1.

The display device 10 is attached to a shelf or other mounting surface as follows. The first portion 68 of the bracket 18 is slidably engaged with the guide channels 74, 74 to releasably secure the back cover 16 of the device to the bracket. The device 10 is attached to a mounting surface such as, for example, the shelf 72 shown in FIG. 10, by means of affixing one end of the double-sided adhesive or pressure sensitive tape 76, 76,(see FIG. 9) to the second portion 70 of the bracket 18, and pressing the other end of the adhesive to the shelf. Alternatively, as shown in FIG. 10, the device 10 may be attached to a shelf or other mounting surface by means of fasteners, such as screws received through the slots 78, 78 of the second portion 70 of the bracket 18 and through aligned slots in the shelf. The slot configuration permits mounting of the display device 10 to all of the major fixture company shelving hole pattern designs. As shown in FIGS. 8 and 10, the bracket 18 preferably extends outwardly from the back cover 16 at an inclined angle such that the display device 10 is positioned at an inclined angle on the shelf 72 to provide maximum display device visibility without interference of the product merchandised on the shelf or a store's ability to scan UPC labels or a product below the shelf.

Figure 12:
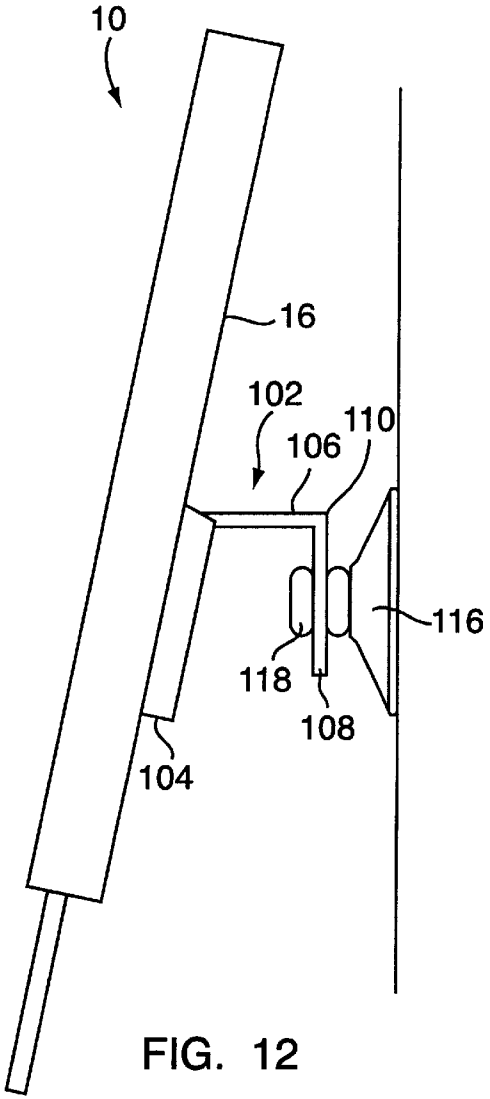
FIG. 12 is a side perspective view of the display device of FIG. 11 attached to a mounting surface.
Figure 11:
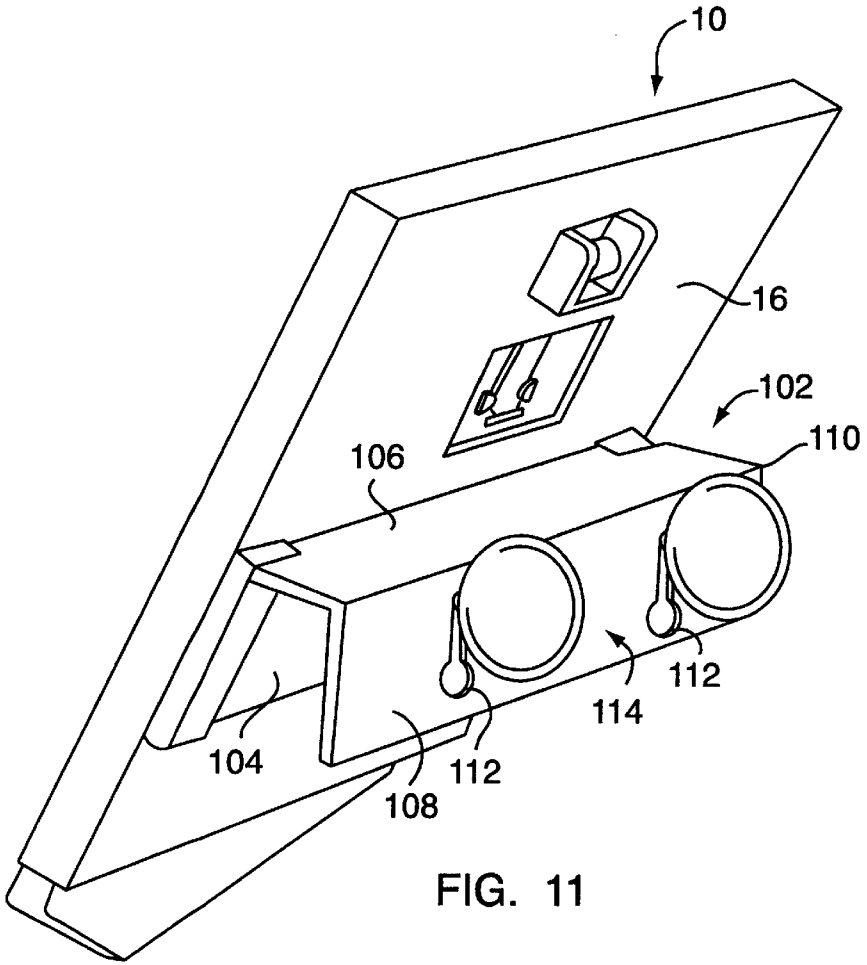
FIG. 11 is a back perspective view of the display device of FIG. 1 with suction cups coupled to a mounting bracket.

With reference to FIGS. 11 and 12, the display device 10 may be attached to another type of mounting surface 100 such as a glass show case or automobile window. A bracket 102 has a first portion 104 for coupling the bracket to the back cover 16 of the display device 10, a second portion 106 extending generally rearwardly from the back cover, and a third portion 108 having an edge 110 joining the second portion. As shown in FIG. 12, preferably the third portion 108 of the bracket 102 is rearwardly spaced from the back cover 16 at a slight angle relative thereto such that the display device 10 inclines away from the mounting surface 100 in a direction from its top to bottom when the mounting surface is vertically disposed. The third portion 108 of the bracket 102 preferably defines one or a plurality of openings or slots 112, 112 for receiving an associated means for attaching the device 10 to the mounting surface 100, such as suction cups 114, 114. As shown in FIGS. 11 and 12, two suction cups 114, 114 are received in associated openings or slots 112, 112 defined in the third portion 108 of the bracket 102. More specifically, each of the suction cups 114, 114 includes a suction member 116 for adhering to the mounting surface 100, and a stem portion 118 for being received through an associated opening 112 of the third portion 108 of the bracket 102.

In operation, the display device 10 mounted on a shelf or other mounting surface shows graphic information on the front cover 12. The panel 14 is biased by the spring 52 in a retracted position where the support portion 40 of the panel substantially underlies the front cover 12 and additional graphic information on the support portion is hidden. A grip portion 42 of the panel 14 projects outwardly from an edge of the front cover 12 and is thereby exposed so that a potential consumer may easily grab and pull on the grip portion in a direction away from the front cover 12. As the grip portion 42 is pulled, the panel 14 moves from a retracted position where the support portion 40 of the panel 14 is hidden beneath the front cover 12 (see FIG. 1) to an extended position where the support portion substantially projects outwardly from the front cover (see FIG. 2). Consequently, additional graphic information on the support portion 40 of the panel 14 is exposed and readable by the potential consumer when the panel is in the extended position.

During movement of the panel 14 from the retracted position to the extended position, the generally unwound end 54 of the spring 52 attached to the upper back side of the support portion 40 of the panel moves with the panel such that the free wound end 56 of the spring 52 located on the shelf 60 of the back cover 16 is partially unwound and paid out through the opening 58 in the back cover. A predetermined minimum length of the wound end 56 of the spring 52 in tension remains in position on the shelf 60 of the back cover 16 when the panel 14 is in the extended position for providing a force to restore the panel to the retracted position.

When the potential consumer is finished reading the additional graphic information on the support portion 40 of the panel 14, the potential consumer gradually releases the tension on the spring 52 so that the spring free end 56 of the spring winds on the ledge and thereby moves the panel to the retracted position where the additional graphic information is again hidden and ready to be exposed by the next potential consumer.

Although the invention has been shown and described in preferred embodiments, it should be understood that numerous modifications can be made without departing from the spirit and scope of the present invention. Accordingly, the present invention has been shown and described by way of illustration rather than limitation.

What is claimed is:

1. A display device comprising:

a substantially rigid back cover to be attached to a mounting surface;

a substantially rigid front cover positioned in overlying relationship to the back cover for showing product identification information;

a substantially rigid panel having a grip portion and a support portion for holding an information sheet, the panel being generally interposed between and movable relative to the covers from a retracted position to an extended position, the panel in the retracted position having the support portion being in substantially underlying relationship to and hidden by the front cover and the grip portion projecting outwardly from an edge of the front cover for providing access to pull the panel to the extended position, the panel in the extended position having the support portion substantially projecting outwardly from the front cover, whereby the information sheet is hidden by the front cover when the panel is in the retracted position, and the information sheet is exposed when the panel is in the extended position; and a flat strip spiral spring having one end coupled to the panel and another end coupled to the back cover for biasing the panel in the retracted position, the back cover defining an opening and a ledge positioned slightly below the opening and projecting rearwardly therefrom, a wound end of the spring being received through the opening and positioned on the ledge, the wound end of the spring being paid out inwardly through the opening when the panel is moved to the extended position.

2. A display device as defined in claim 1, wherein the front cover and the back cover cooperate to define a channel therebetween for accommodating the support portion of the panel.

3. A display as defined in claim 1, wherein the back cover further includes rearwardly projecting sidewalls associated with the ledge for retaining the wound end of the spring in position on the ledge.

4. A display device as defined in claim 1, wherein the support portion includes a support surface and a plurality of projections about a periphery of the support portion, the projections spaced above and extending over the periphery of the support surface for retaining the information sheet against the support surface.

5. A display device as defined in claim 4, wherein the support surface defines an opening for providing access to a back side of the information sheet so that the sheet may be pushed against and removed when the panel is in the extended position.

6. A display device as defined in claim 1, wherein the grip portion of the panel is in the form of an arrow pointing away from the front cover.

7. A display device as defined in claim 1, wherein a back surface of the grip portion of the panel defines ribs for providing an enhanced gripping surface.

8. A display device as defined in claim 1, further including a mounting bracket coupled to the back cover for attaching the display device to a mounting surface.

9. A display device as defined in claim 8, wherein the bracket extends outwardly from the back cover at an inclined angle such that the display device is positioned at an inclined angle when the bracket is attached to a mounting surface.

10. A display device as defined in claim 8, wherein the bracket defines a plurality of slots for receiving fastening means to secure the display device to a mounting surface.

11. A display device as defined in claim 8, wherein the back cover includes guide channels projecting rearwardly therefrom for engaging the bracket.

12. A display device as defined in claim 8, further including at least one suction cup coupled to the bracket for adhering to a mounting surface.

* * * * *